US005358242A

United States Patent [19]

Trudeau et al.

[11] Patent Number: 5,358,242

[45] Date of Patent: Oct. 25, 1994

[54] BALL STORAGE DEVICE FOR PINBALL GAMES

[75] Inventors: John T. Trudeau, Bolingbrook; Ernie Pizzarro, Chicago, both of Ill.

[73] Assignee: Williams Electronics Games, Inc., Chicago, Ill.

[21] Appl. No.: 150,977

[22] Filed: Nov. 12, 1993

[51] Int. Cl.[5] ..... A63F 7/30

[52] U.S. Cl. ..... 273/119 R; 273/127 R; 273/121 A; 273/119 A

[58] Field of Search ..... 273/118-125, 273/127 R, 127 C

[56] References Cited

U.S. PATENT DOCUMENTS 2,618,486 11/1952 Durant ..... 273/121 A
5,120,059 6/1992 Oursler ..... 273/118 A X
5,226,653 7/1993 Bil et al. ..... 273/118 A X

*Primary Examiner*—Vincent Millin
*Assistant Examiner*—Raleigh W. Chin
*Attorney, Agent, or Firm*—Rockey, Rifkin and Ryther

[57] ABSTRACT

A planetary ball storage device for a pinball game according to the present invention consists of a horizontally disposed rotating wheel having a plurality of pinball receiving pockets arrayed on the periphery of the wheel. The game player, using the flippers, can direct a ball into an empty pocket when a pocket is in a ball receiving position after a predetermined game objective has been met. Balls are returned to the playfield by the utilization of a magnetic lifter arm controlled by the game microprocessor. The wheel is rotated by an electric motor and its position is detected by an optical switch assembly. A second optical switch assembly generates a signal to energize the magnetic lifter arm.

10 Claims, 3 Drawing Sheets

BALL STORAGE DEVICE FOR PINBALL GAMES

BACKGROUND OF THE INVENTION

The present invention relates generally to pinball games and, more particularly, to an improved play feature for such games which is designed to foster and to maintain player interest in the games. A typical pinball game includes an inclined playfield which supports a rolling ball, a vertical backbox and a variety of play features. The person who plays the game controls flippers mounted on the playfield which, when activated by the player at the appropriate time, return the pinball back into play. A typical object of pinball games is for the player to direct pinballs at selected play features or targets to score points.

A recent development in the art of pinball games is the utilization of multiple balls during game play, requiring the player to control many pinballs on the playfield simultaneously. The appeal of pinball games providing multiple ball play is greatly enhanced due to the difficulty and excitement involved in maintaining all of the pinballs in play.

As a result, mechanisms must be provided to retain and store the extra pinballs until the player achieves multiple ball play, as when a predetermined game objective is achieved. Then, the game microprocessor activates the ball retaining mechanism to release the extra balls onto the playfield.

Prior mechanisms for multiple ball play comprised relatively simple ball poppers having some storage capacity. While such a mechanism accomplishes multiple ball play, its utilization does not foster nor maintain player interest in the game. It is desirable to provide a multiple ball play storage device which is more detailed and involved to keep game players interested in the game.

SUMMARY OF THE INVENTION

The play feature of the present invention consists of a horizontally disposed rotating wheel having a plurality of pinball receiving pockets arrayed on the periphery of the wheel. The game player, using the flippers, can direct a ball into an empty pocket. Balls are returned to the playfield by the utilization of a magnetic lifter arm controlled by the game microprocessor. The wheel is rotated by an electric motor and its position is detected by optical sensors and interrupters.

DETAILED DESCRIPTION OF A PREFERRED EMBODIMENT

Figure 1:
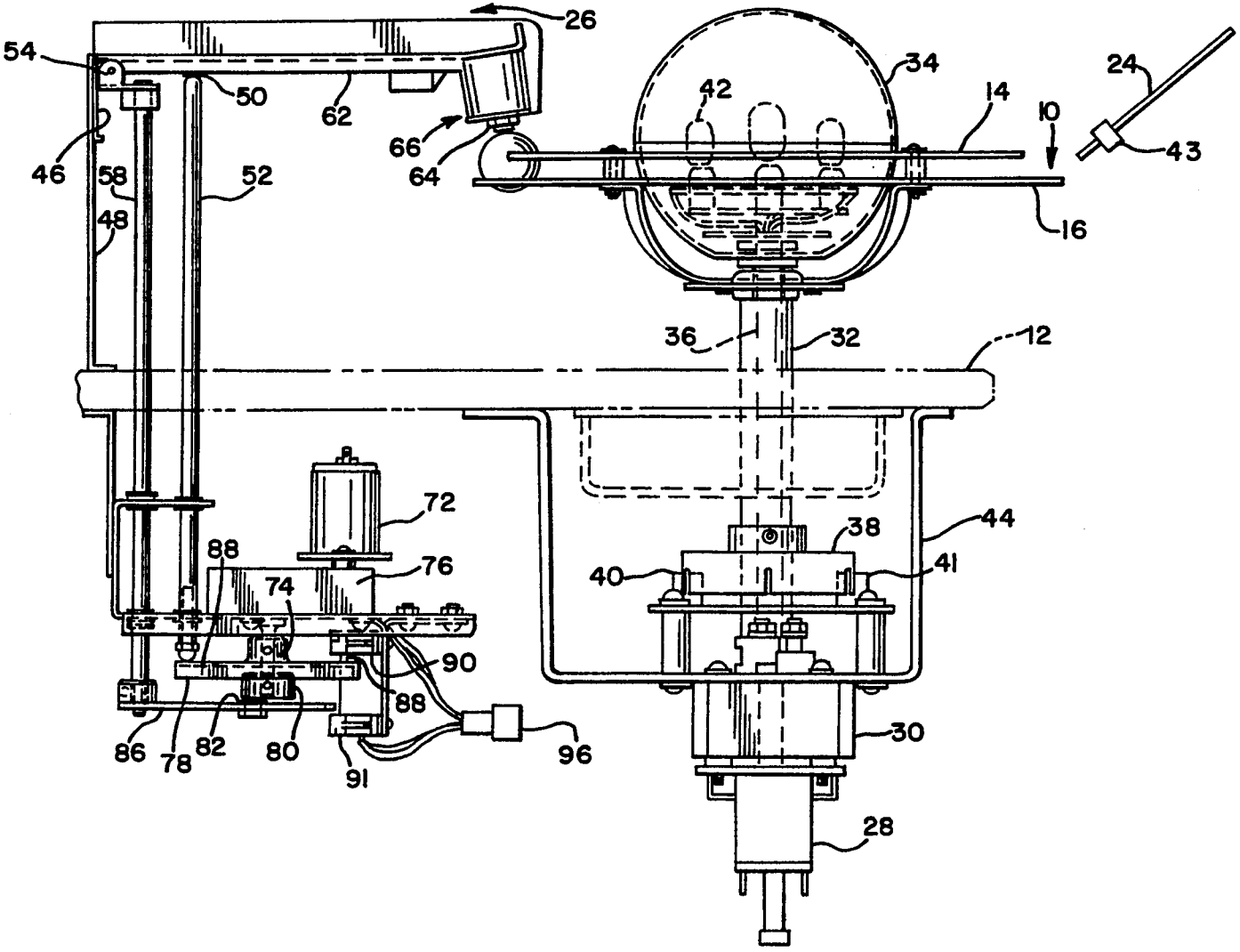
FIG. 1 is a side view of the play feature according to the present invention.
Figure 2:
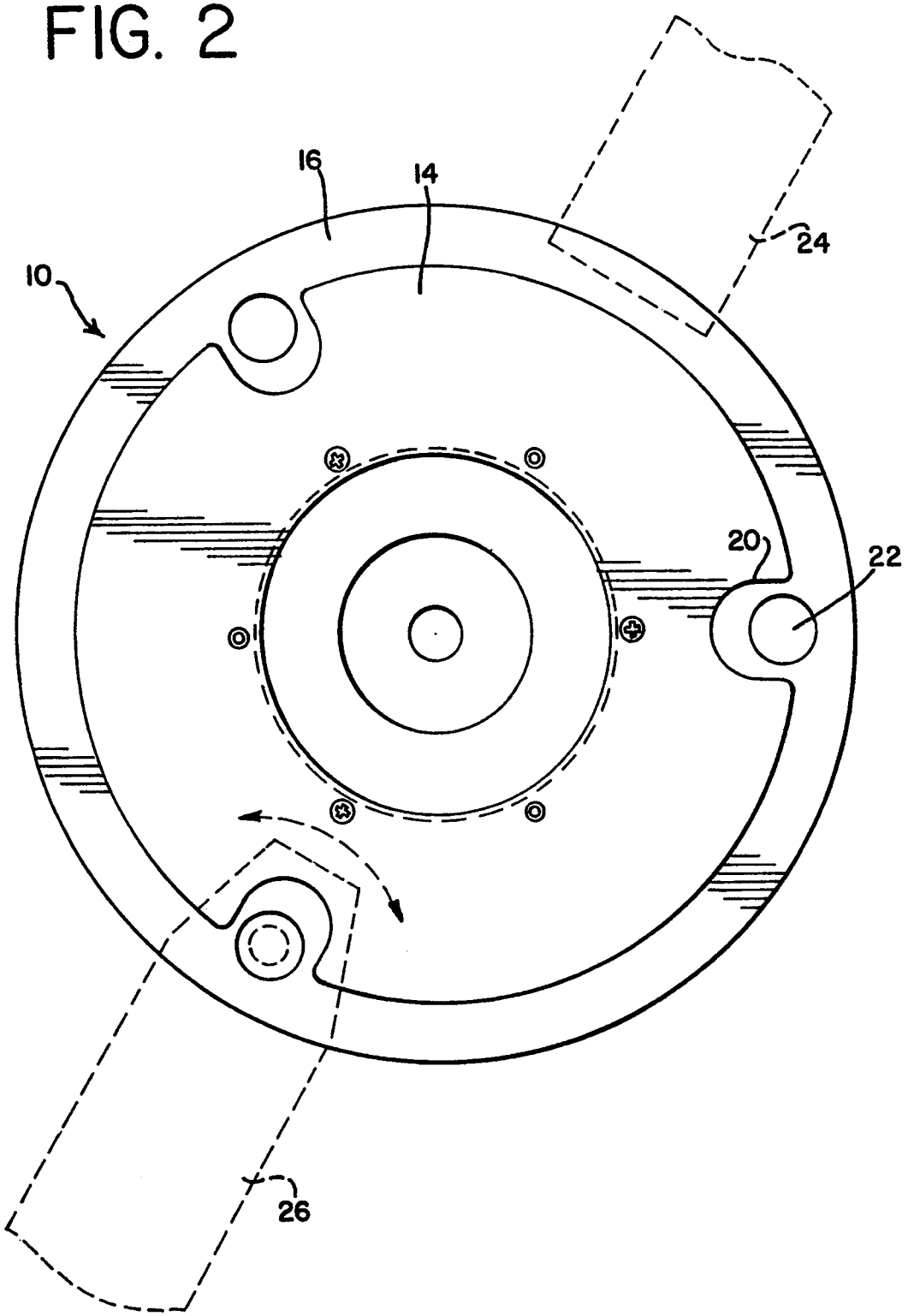
FIG. 2 is a top view of the rotating wheel containing the ball receiving pockets illustrating the ramp and the sideways rotation of the magnetic lifter arm.

Referring to FIG. 1, a side view of the play feature of according to the present invention is illustrated. A horizontally disposed wheel 10 rotates above playfield 12 and includes upper ring 14 and lower ring 16. As shown in FIG. 2, wheel 10 is provided with a plurality of ball receiving pockets each of which is defined by a recess 20 formed in the upper ring 14 and a support aperture 22 formed in the lower ring 16. Each of the support apertures 22 has a diameter less than one pinball diameter, thereby to support a pinball therein.

Balls are delivered to the wheel 10 from a ramp 24 and come to rest in the support aperture 22 and against the recess 20 of a receiving pocket as a pocket rotates to the entrance position of ramp 24. Optical switch 43 is attached to the ramp 24 and generates a signal which is sent to the game microprocessor when a pinball passes by it. This initiates the rotation of the wheel 10.

Balls exit the wheel 10 when a pinball is in a ball discharge position disposed under magnetic lifter arm 26. The arm 26 serves to lift the ball out of the pocket, rotates it away from the wheel 10 and then releases the ball onto the playfield 12.

Electric motor 28 rotates the wheel 10 via gear assembly 30 and shaft 32 in addition to rotating the ornamental sphere 34, preferably in the opposite direction via gear assembly 30 and counterrotating shaft 36. The motor 28 is connected to the playfield 12 by means of supporting bracket 44.

Mounted on the shaft 32 is an optical interrupter 38 which actuates the optical switches 40 and 41 to generate signals indicative of the relative rotational position of the wheel 10. Attached to the inside of ornamental sphere 34 are a plurality of lights 40 which can be made to blink to foster player interest in the game.

Figure 3:
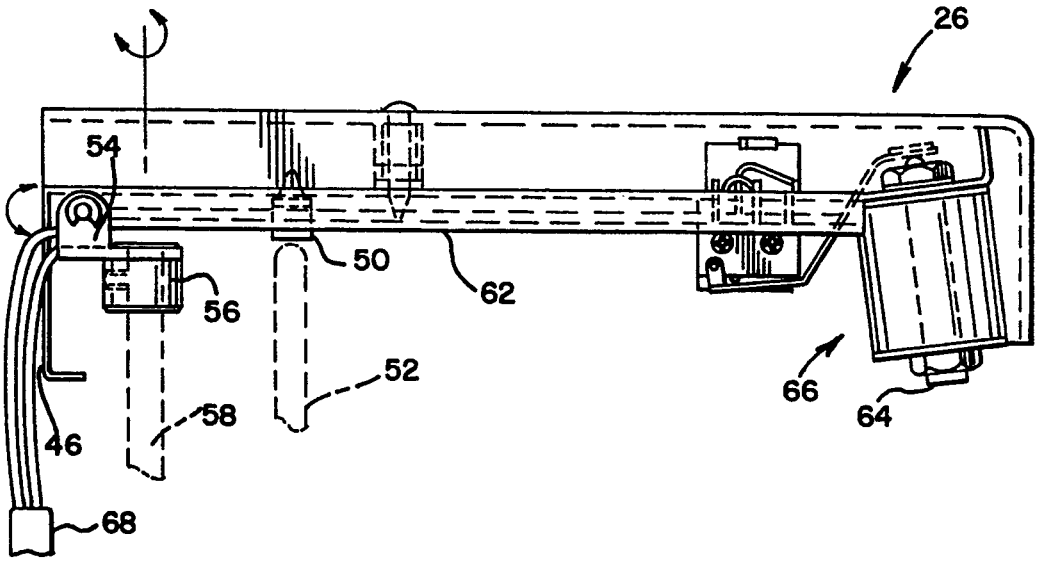
FIG. 3 is a side view of the magnetic lifter arm.

Referring to FIG. 3, a more detailed view of the magnetic lifter arm 26 is illustrated. Lifter arm 26 is mounted on the playfield 12 by frame member 46 and support bracket 48 (FIG. 1). A cam pad 50 is attached to a horizontal arm portion 62 which can be vertically rotated about the axis of hinge 54 when the cam member 52 contacts the cam pad 50 to lift a ball from the wheel 10. The lifter arm 26 rotates horizontally about the axis of shaft 58 to which it is connected. An electromagnet 64 is attached to the end 66 of the lifter arm 26 opposite the hinges 54 and 56 and is selectively energized by the microprocessor through cable 68.

Figure 4:
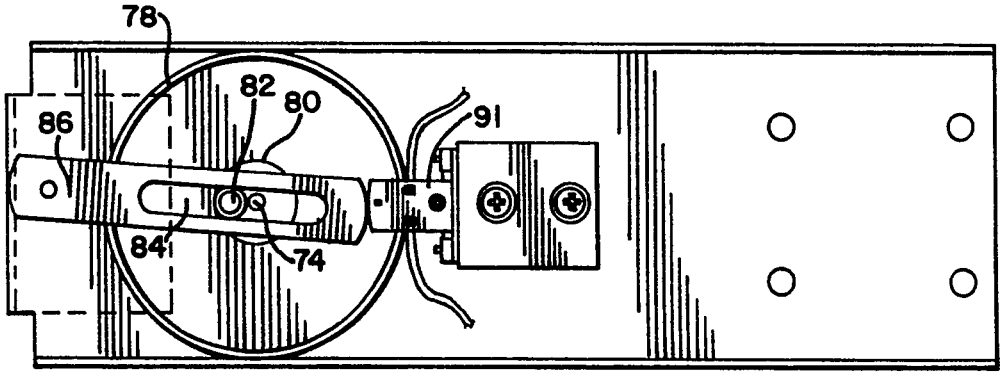
FIG. 4 is a bottom view of the assembly used to rotate the magnetic lifter arm.

FIGS. 1 and 4 illustrate the structure for operating moving the magnetic lifter arm 26. An electric motor 72 drives a shaft 74, shown in phantom, via a gear reducer 76. Interrupter disc 78 and eccentric 80 each rotate with the shaft 74. A pair of optical switches 90 and 91 cooperate with the disc 78 to generate a signal sent to the game microprocessor through cable 96 to energize the electromagnet 64.

The arm 26 is vertically moved as follows: cam lifter 88 is provided on the edge of the top face of interrupter disc 78 to lift a cam member 52, and, in turn, the magnetic lifter arm 26, once per revolution of the disc 78.

Magnetic lifter arm 26 rotates horizontally when the pivot shaft 58 is rotated by the movement of the pivot arm 86. Pivot pin 82 projects downwardly from an edge of the eccentric 80 and is trapped in the channel 84 of pivot arm 86. Circular rotation of the pivot pin 82 and its corresponding reciprocating movement within the channel 84 causes the pivot arm 86 to horizontally rotate back and forth.

Operation of the play feature according to the present invention is as follows. When the pinball game begins, all of the ball receiving pockets are preferably empty. The play feature of the invention has two modes of operation: a first mode where the play feature is not selected and a second mode where the game microprocessor selects the play feature.

A game player directs pinballs onto the ramp feeding the play feature. A ball on the ramp 24 closes the optical switch 43 adjacent the end of the ramp 24 to generate a signal sent to the game microprocessor. This actuates the motor 28 to index the wheel 10 to deposit the ball into a pocket 22.

In a first mode of operation, the wheel 10 is indexed such that the ball received in a pocket 22 is immediately rotated to the discharge position beneath the magnetic lifter arm 26. When this position is reached, the interrupter 38 is positioned relative to optical switches 40 and 41 to generate a signal sent to the game microprocessor to turn off the motor 28 and start the lifter arm cycle. Thus, the ball received in a pocket 22 is immediately returned to the playfield.

In the second mode of operation when the play feature is "selected," balls are retained in the wheel 10. The wheel 10 is indexed to fill each empty pocket but does not actuate the lifter arm. This process continues until all of the empty pockets 22 are filled. When a predetermined game objective has been met, such as achieving a certain score or making a difficult shot using the flippers, all of the pinballs stored in the pockets 22 are rapidly discharged onto the playfield by the lifter arm 26 to provide a multiple ball play feature.

Balls are discharged from a pocket 22 in the discharge position as follows. The motor 72 is actuated which rotates the eccentric 80 and the interrupter disc 78 via the gear reducer 76 and the shaft 74. The magnetic lifter arm 26 is thus horizontally rotated from its rest position over the playfield to a position where electromagnet 64 is over a ball resting in a pocket 22. Rotation of the lifter arm 26 into this position corresponds to an interrupter 78 orientation between the optical switches 90 and 91 which generates a signal to energize the electromagnet 64 to pick up the pinball.

The magnetic lifter arm 26 is then pivoted vertically about the hinge 54 when the cam lifter 88 raises the cam member 52 into contact with the cam pad 50. Simultaneously, the lifter arm 26 is horizontally rotated. Thus, the ball is lifted and moved from the wheel to a discharge location over the playfield 12.

Next, optical switches 90 and 91 open signalling the game microprocessor to deenergize the electromagnet 64 to drop the pinball back into play. This process is repeated, as controlled by the game microprocessor, until all of the pinballs contained in the receiving pockets are returned to play.

The planetary ball storage device according to the present invention can be modified to foster player interest in the game. For example, the wheel 10 could be spun by the motor 28 to provide entertaining visual effects. Also, the wheel could be directed to discharge the balls when any number of receptacles are filled or after the game player has achieved any number of differing game objectives. Finally, ornamentations can be provided within the sphere 40 which light up whenever certain targets are hit or other predetermined game objectives have been met.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A ball storage device for a pinball game having an inclined playfield supporting a plurality of ferromagnetic balls thereon comprising:

a) a horizontally disposed wheel having a plurality of pinball receiving pockets arrayed around its periphery for receiving balls;

b) means for delivering a ball to said wheel;

c) means for rotating said wheel such that one of said receiving pockets is positioned to receive the ball from the delivering means; and d) means for removing and discharging balls from said receiving pockets, said means for removing including an electromagnetic arm for lifting balls from said receiving pockets.

2. The ball storage device of claim 1 wherein said means for removing includes means for rotating the electromagnet away from the wheel to a ball discharge position.

3. The ball storage device of claim 1 further comprising means for actuating said means for rotating only when a ball is detected on said delivering means.

4. The ball storage device of claim 3 further comprising means for deactuating said rotating means when a ball received in one of said pockets is in a discharge position relative to the removing means.

5. The ball storage device of claim 1 wherein said means for delivering comprises a ramp.

6. A ball storage device for a pinball game having an inclined playfield supporting a plurality of ferromagnetic balls thereon comprising:

a) a horizontally disposed wheel having a plurality of pinball receiving pockets arrayed around its periphery for receiving balls;

b) means for delivering a ball to said wheel;

c) means for rotating said wheel such that one of said receiving pockets is positioned to receive the ball from the delivering means; and d) means for removing and discharging balls from said receiving pockets, said means for removing including means for lifting a ball from the wheel and means for horizontally rotating said lifting means away from the wheel to a ball discharge position.

7. The ball storage device of claim 4 wherein said lifting means comprises an electromagnetic lifter arm.

8. The ball storage device of claim 6 further comprising means for actuating said means for rotating only when a ball is detected on said delivering means.

9. The ball storage device of claim 6 further comprising means for deactuating said rotating means when a ball received in one of said pockets is in a discharge position relative to the removing means.

10. The ball storage device of claim 6 wherein said means for delivering comprises a ramp.

* * * * *